US005549299A

United States Patent [19]

Brown

[11] Patent Number: 5,549,299

[45] Date of Patent: Aug. 27, 1996

[54] APPARATUS FOR PLACING GOLF BALL ON TEE

[76] Inventor: Louis S. Brown, 401 Colbert Ave., Pensacola, Fla. 32507

[21] Appl. No.: 479,102

[22] Filed: Jun. 7, 1995

[51] Int. Cl.[6] ..... A63B 57/00

[52] U.S. Cl. ..... 473/133; 473/135

[58] Field of Search ..... 273/33, 201, 200 A, 273/200 B, 202, 204, 207, 208, 209, 195 R, 196, 197 R, 197 A, 198, 195 B

[56] References Cited

U.S. PATENT DOCUMENTS

| | | | |
|---|---|---|---|
| 2,051,253 | 8/1936 | Goehler et al. | 273/201 |
| 2,618,480 | 11/1952 | Williams | 273/201 |
| 2,643,883 | 6/1953 | Hogeberg | 273/201 |
| 4,662,641 | 5/1987 | Peyret, Jr. | 273/201 |
| 5,297,797 | 3/1994 | Lamontagne | 273/201 |

FOREIGN PATENT DOCUMENTS

| | | | |
|---|---|---|---|
| 6071005 | 3/1994 | Japan | 273/201 |

*Primary Examiner*—Steven B. Wong

*Attorney, Agent, or Firm*—Joseph C. Mason, Jr.; Louise A. Foutch

[57] ABSTRACT

An automatic apparatus that positions a golf ball on a tee retrieves and positions a new ball on the tee each time a golfer makes a tee shot. A bucket of balls is charged into the apparatus, and a ramp directs the balls, one at a time, to a tee loading station. A plunger drives a ball in the tee loading station into contact with a horizontally positioned tee. The tee has a bore formed in it that communicates with a source of negative pressure so that a ball driven into contact with the tee by the plunger is held to the tee by a vacuum. The resulting increase in a vacuum line reconfigures a four way valve and activates a mechanism that rotates the tee and ball into a vertical position so that the golfer may make a tee shot. The shot disconnects the ball from the tee, resulting in bleeding of the vacuum line, and the drop in pressure reconfigures the four way valve. The valve activates a mechanism that returns the tee to its horizontal position so that it may retrieve another ball from the tee loading station. In a final embodiment, the tee moves in a straight line toward the golfer after retrieving a ball so that the golfer may practice hitting a moving target.

19 Claims, 13 Drawing Sheets

APPARATUS FOR PLACING GOLF BALL ON TEE

BACKGROUND OF THE INVENTION

1. Field of the Invention

This invention relates, generally, to devices having utility in practicing or playing the game of golf. More particularly, it relates to an apparatus that automatically places a golf ball on a tee.

2. Description of the Prior Art

Since those who want to play the game of golf well must invest many hours of practice thereinto, driving ranges have been established sot hat golfers desiring to practice their tee shot may stand in one location and hit numerous shots without having to retrieve the balls.

Typically, a golfer pays a fee to the owner of a driving range for a bucket containing a predetermined number of golf balls. The bucket is carried to a concrete pad, typically covered with an artificial turf, and the golf balls are removed from the bucket, one at a time, and placed on a tee means that is mounted on the pad. After each ball has been hit, the golfer retrieves another ball from the bucket, places it on the tee, and makes another practice tee shot.

The act of retrieving balls from the bucket requires the golfer to bend over or to kneel down. Moreover, the ball must be placed on a tee while the golfer remains in the bent or kneeling position. Then, the golfer must return to a standing position to make the next shot.

This repeated bending and standing may increase the golfer's fatigue as the driving practice continues. Moreover, the time required to position a new ball on the tee after each shot ensures that emptying a single bucket can take a substantial amount of time.

What is needed, then, is a reliable device that will automatically position a new ball on a tee as soon as a tee shot has been made. If such a device were available, it would eliminate the stooping and bending associated with manual ball deployment, and shorten the time required to complete a driving range session, thereby increasing the cash flow of the owner of the driving range.

A device intended to fulfill the identified need is disclosed in U.S. Pat. No. 4,662,641 to Peyret, Jr. Although the device is operable, it is somewhat expensive to manufacture, has a relatively high power consumption rate because it must generate a high vacuum, and is susceptible to a number of problems that will be mentioned not in denigration of the invention but to indicate some of the limitations sought to be overcome by the present invention. In operation, the earlier device fails to pick up an unreasonably high percentage of balls. Of the balls that are picked up, too many of them fall from the tee before the tee attains its vertical position. Moreover, the device loses its vacuum during the last few degrees of travel as the tee approaches its horizontal position, nor can a positive vacuum be assured at any stage of the operation of the device because of the seal design. Additionally, a distractingly high decibel level is produced by the required powerful vacuum motor; such noise disturbs the tranquillity of the practice range.

Since the lip of the tee is a part of the belt that moves the tee, degradation of the tee lip requires replacement of the entire belt. The height of the machine is between eight to nine inches, thereby not meeting the standards of some states, like California, that ban devices of that height if no step is provided. Finally, the device requires outside ball storage.

A device having none of the limitations of the earlier devices, if developed, would advance the art.

SUMMARY OF THE INVENTION

The present invention includes an opening into which is poured a plurality of golf balls from a bucket. The balls are supported within the device on a ramp that is slightly tilted with respect to horizontal so that the balls are urged by the force of gravity toward a tee loading station. The ramp is configured so that only one ball at a time may enter into the tee loading station.

The invention includes numerous embodiments, but all of said embodiments operate in accordance with the same principles. The primary difference between embodiments resides in the mechanism for reciprocating the tee between a horizontal position where it receives a ball at the tee loading station and a vertical position where it presents the ball for hitting by the golfer.

In all embodiments, a vacuum is employed to operate the device. Control is provided by a four way vacuum operated air pressure valve that sequentially directs air pressure to various locations within the device.

Moreover, a mechanism is provided whereby a tee is disposed in a horizontal plane so that it may receive a ball positioned in the tee loading station. As soon as a ball is loaded onto the horizontal tee, the mechanism quickly rights the tee so that the ball carried thereby is presented to the golfer so that a practice tee shot can be made.

The novel structure senses the departure of a ball from the tee so that as soon as the golfer completes the shot, the tee returns to its horizontal position and retrieves another ball at the tee loading station. In this way, a golfer can hit an entire bucket of balls without bending over after each shot and without being required to position a ball on a tee.

In one embodiment, the tee not only rights itself, it also travels along a path of travel toward the golfer so that the golfer may practice hitting a moving ball, thereby increasing hand-eye coordination.

The tee-loading mechanism in all embodiments includes a vacuum source in fluid communication with a bore formed in the tee, and a plunger that pushes a ball into the tee. A ball in the tee loading station is thus held onto the tee by the vacuum.

More particularly, when the tee is in its horizontal position, it activates a popper valve in fluid communication with the four-way valve. The four way valve directs the pressure to an actuator having a plunger that drives the ball into the tee, and then directs the pressure to another actuator that positions the tee into an upstanding configuration so that the golfer may make a tee shot.

When a ball has been hit, the resulting drop in the vacuum in the line leading from the vacuum source to the tee causes the four way valve to reconfigure itself, causing the mechanism to return the tee to its horizontal position so that another ball can be retrieved.

Another embodiment includes means for positioning the tee, when in its vertical position, in a low, medium, or high position to simulate a ball lying in tall grass, medium height grass, or on a tee, respectively.

It is therefore apparent that the primary object of this invention is to provide a machine that includes a self-setting adjustable height golf tee that is free of the limitations of earlier devices in this field.

Another important object is to accomplish the foregoing object with a reliable mechanism that provides many hours of maintenance-free service.

Still another object is to fulfill the primary object with a light-in-weight, low profile device that is quiet in operation, completely portable, which may be battery operated if desired, and which has an internal ball storage.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
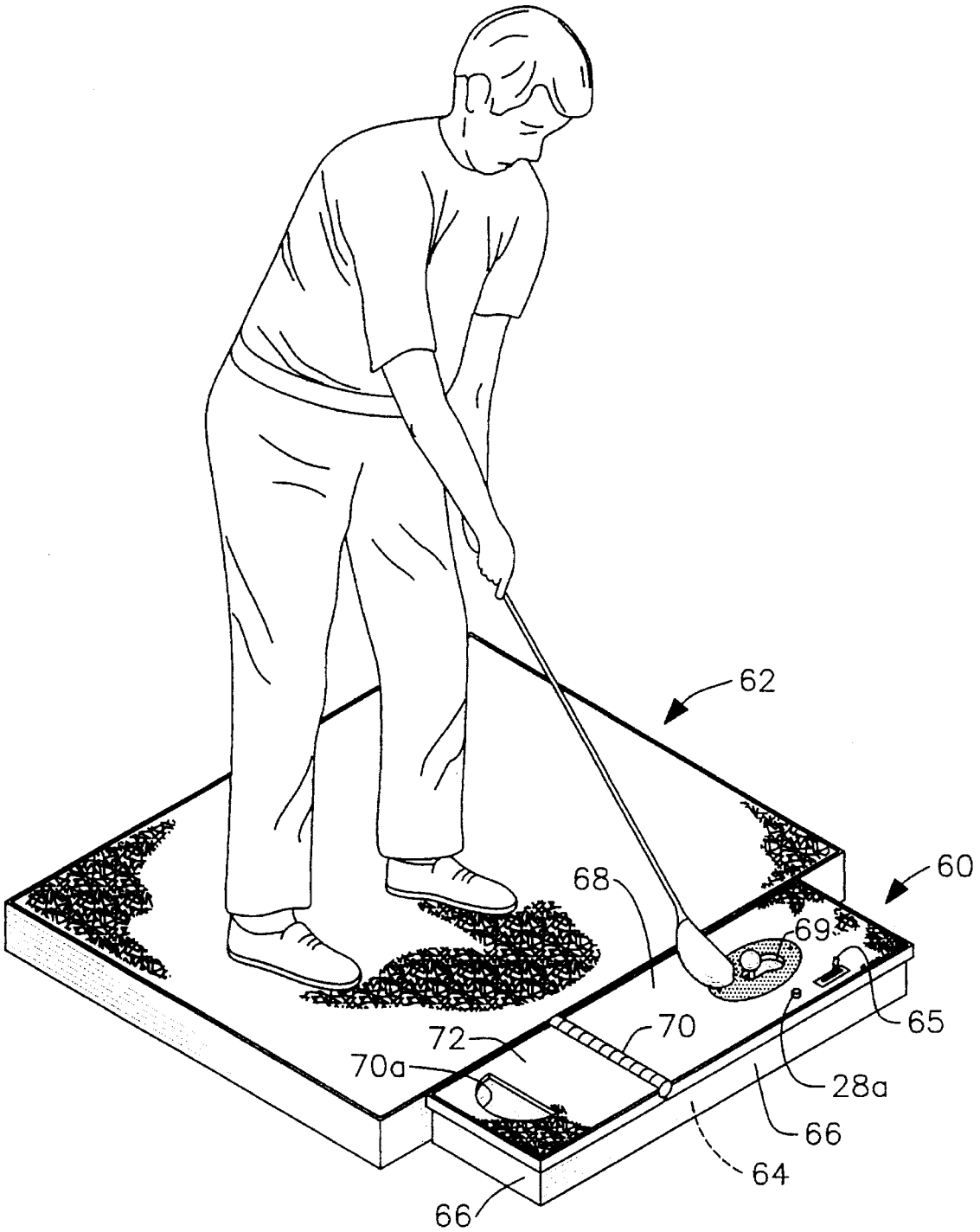
FIG. 1 is a perspective view of a golfer standing atop the novel device, preparing to address a golf ball positioned atop the novel tee.

Referring now to FIG. 1, it will there be seen that an illustrative embodiment of the invention is denoted as a whole by the reference numeral 60. A golfer stands atop platform 62 when using device 60. There are several control means and several mechanical configurations that may be represented by device 60, and such control means will be introduced first.

Figure 2:
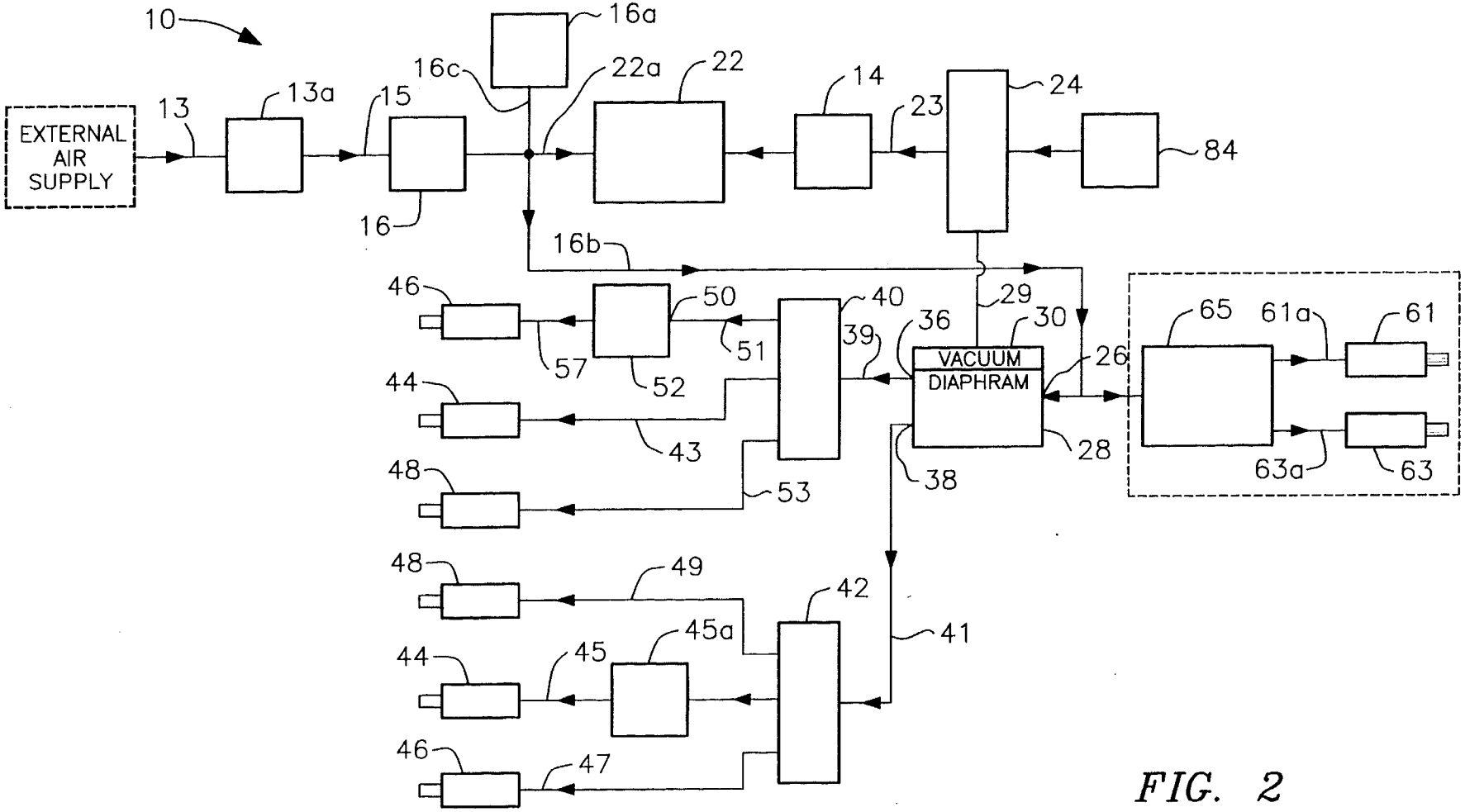
FIG. 2 is a schematic of the novel control means utilizing an external air supply and vacuum generator.
Figure 3:
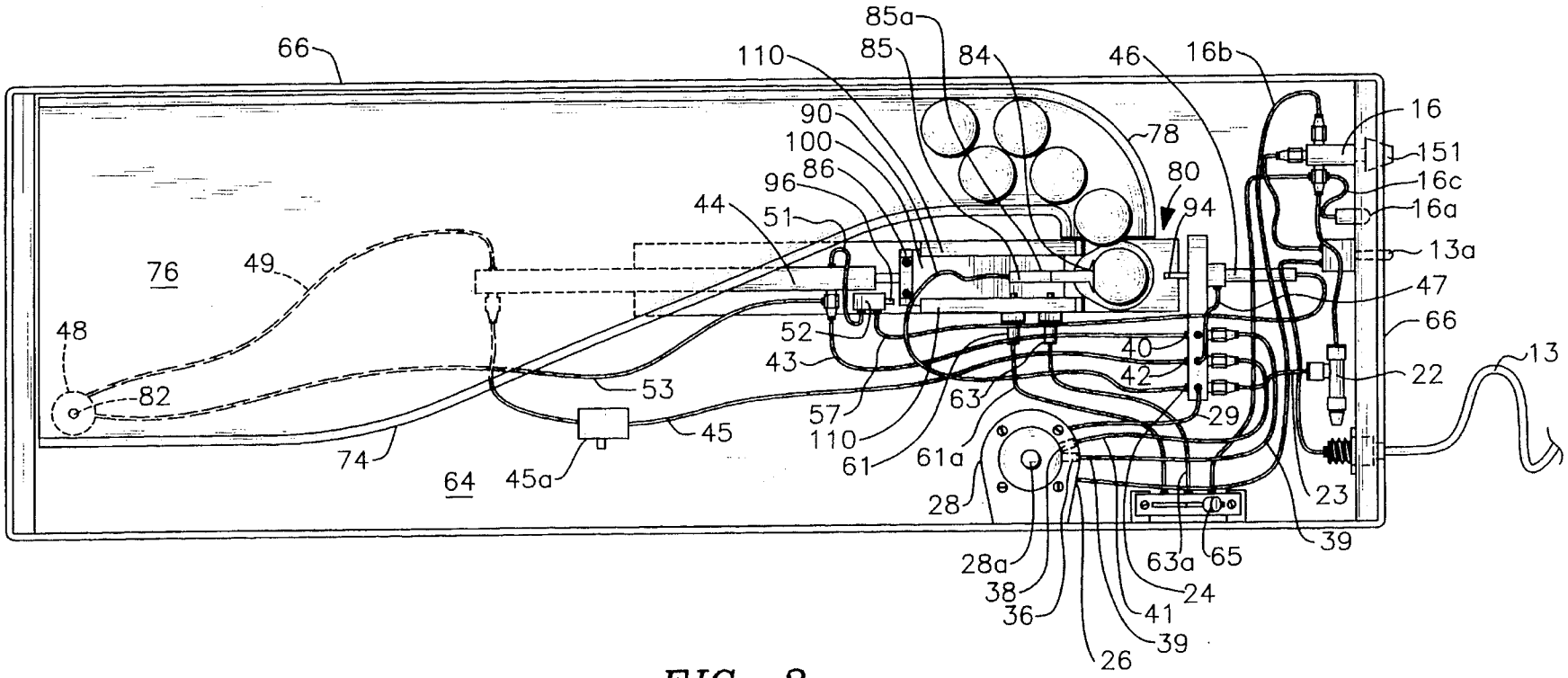
FIG. 3 is a top plan view of a first exemplary embodiment of an apparatus for alternatively positioning the tee in vertical and horizontal positions, with its top wall removed to show the ball ramp and other important features.

FIG. 2 is a diagrammatic representation of the control means for the mechanical assembly depicted in FIG. 3.

Control means 10 includes an external air supply 13 to on/off valve 13*a*. Air at a first pressure is delivered through line 15 to pressure reducing valve 16, (having rotatable flow control knob 151) air at a second, lower pressure is delivered to pressure indicator 16*a* through line 16*c*, air to vacuum generator 22 is delivered through line 22*a*, and air to the 4-way valve pressure inlet 26 is delivered through line 16*b*.

Vacuum generator 22 supplies a vacuum through line filter 14 to vacuum manifold 24 through line 23. More particularly, air from pressure reducing valve 16 flows straight through vacuum generator 22 into ambient, creating a venturi effect which is harnessed by vacuum line 23.

Vacuum manifold 24 simultaneously supplies a vacuum to diaphragm 30 of four way valve 28 through line 29 and to golf tee 84.

Four way valve pressure outlet 36 is in communication with pressure manifold 40 through line 39 and pressure outlet 38 is in communication with pressure manifold 42 through line 41.

First actuator 44 is in fluid communication with pressure manifold 40 through line 43 when said first actuator is in its contracting state, and said first actuator 44 is in fluid communication with pressure manifold 42 via line 45 when said first actuator 44 is in its extending state.

Second actuator 46 is in fluid communication with pressure manifold 42 via line 47 when said second actuator 46 is in its contracting state, and third actuator 48 is in fluid communication with said first actuator 44 when said first actuator is in its extending state via line 49. When said first actuator 44 is in its extending state via line 49, said third actuator 48 is also in its extending state.

When first actuator 44 is in its contracting state, it is in simultaneous fluid communication with inlet 50 of a poppet valve 52 via line 51 and with third actuator 48 in its contracting state via line 53.

The outlet of popper valve 52 is in fluid communication with second actuator 46 in its extending state through line 57. The elements contained in the box drawn with broken lines in FIG. 2 (and FIG. 2A) are optional. As more fully explained hereinafter in connection with FIG. 3, said elements include a switch 65 in fluid communication with four way valve 28 and a pair of actuators 61, 63, connected to said switch through lines 61*a* and 63*a*, respectively.

Figure 2A:
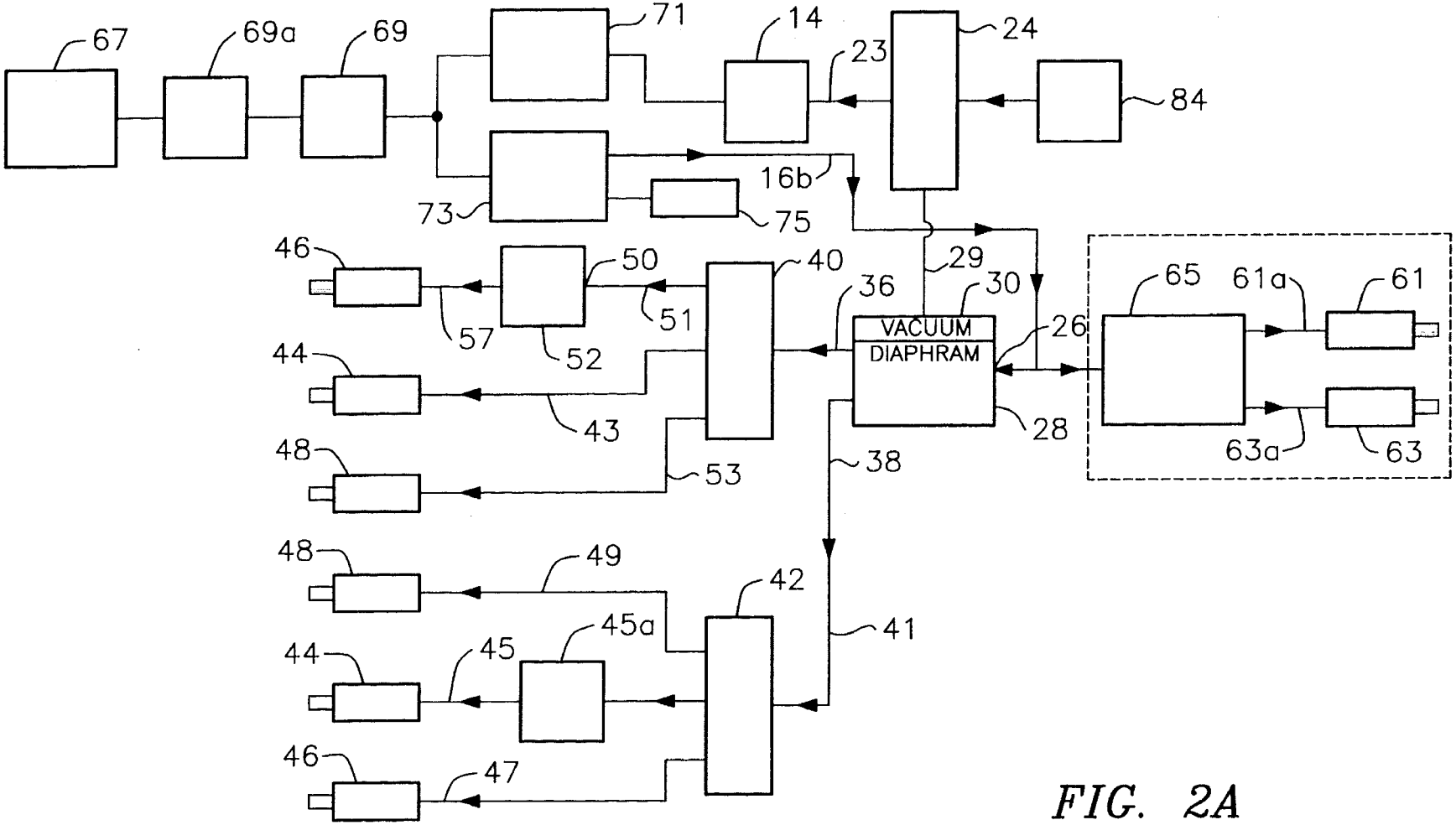
FIG. 2A is a version of FIG. 1 using an internal battery to power a vacuum pump and air pump.

FIG. 2A discloses a variation of the second embodiment of the invention having an internal air/vacuum supply. It includes an internal 12 volt battery 67 that is electrically connected through an inline fuel 69*a* and an on/off manual switch 69 to an internal vacuum pump 71 and an internal air compressor 73 having filter intake 75.

An exemplary mechanical structure controlled by control means 10 or variations thereof is denoted 60 as a whole in FIG. 1 as aforesaid.

Self-setting tee apparatus 60 includes an elongated base having a bottom wall 64 and upstanding sidewalls 66 mounted about the periphery thereof. A golfer may stand atop platform 62 when using apparatus 60, or the apparatus could be recessed into the ground so that its top wall 68 is flush with a ground surface. Flat top wall 68 having tee-receiving slot 69 formed therein is supported along its peripheral edges by said sidewalls 66. A hinge 70 enables opening of hatch 72 so that a bucket of golf balls may be introduced into the hollow interior of apparatus 60.

Alternatively, a ball-receiving opening 70*a* could be formed in top wall 68 in the trailing end thereof, as also depicted in FIG. 1, so that balls from a bucket could be charged into the apparatus through said opening, thereby obviating the need for hinge 70.

Apparatus 60 is positioned adjacent platform 62 when said apparatus is in use; said base and platform may be attached to one another or provided as separate parts. Both apparatus 60 and platform 62 are less than five inches in height.

As disclosed in FIG. 3, a tray 74 positioned atop bottom wall 64 has a wide first end 76 that is tilted slightly from horizontal to feed balls under the force of gravity toward a second narrow end or neck 78 that terminates at tee loading station 80. Third actuator 48 is preferably a double acting air cylinder; it includes an upstanding plunger 82 connected to a bottom side of said first end 76 and performs the function of periodically josEling said first end to help jostle the balls toward tee loading station 80.

Tee 84 includes elongate stem 85. A central bore 85*a* shown, is formed in the tee and in the stem, and is in open communication with said tee loading station 80 at a leading end thereof and with a vacuum line 90 at a trailing end thereof, said vacuum line being in fluid communication with vacuum manifold 24.

Second actuator 46 is a double-acting air cylinder having tee-loading plunger 94 positioned at the leading end of tee loading station 80. When tee 84 rotates into its horizontal or down position, the trailing end of mounting block 86 depresses the popper valve stem 96 that opens poppet valve 52. Activation of said poppet valve 52 causes second actuator 46 to extend or retract, depending upon the position of four way valve 28. When extended, plunger 94 positions a ball into engaged relation with tee 84.

The sequential operation of the novel apparatus is best understood by considering the state of the four-way valve, the poppet valve, the vacuum, and all actuators during each of the four modes of the apparatus.

The first mode is the ball strike mode. When in this configuration, tee 84 is in its vertical position and a ball is gripped by a vacuum appearing in vacuum line 90. Popper valve 52 is closed, because said popper valve is open only when the tee is in its horizontal position as depicted in FIG. 3. The vacuum is closed because the ball is seated on the tee and the vacuum cannot bleed. Port 38 of four way valve 28 is open, actuator 46 is retracted, actuator 48 is extended, and actuator 44 may be in a retracted or extended configuration, depending upon the particular mechanism employed to effect righting of the tee, as will be disclosed hereinafter.

When the golfer strikes the ball, or manually removes it from the tee, the mechanism is said to be in its ball-struck mode. Since the ball is no longer seated on the tee, the vacuum is bleeding. The poppet valve remains closed, because the tee has not yet returned to its horizontal position, i.e., the tee is just beginning to rotate back into its horizontal position to retrieve another ball. Four-way valve 28 shifts to open port 36, and actuator 44 (connected to said port 36 through line 39) begins retracting. Actuator 46 is retracted so that a new ball can enter into tee loading station 80, and actuator 48 is retracted so that tray 74 returns to its position of repose. The purpose of actuator 48 is to jostle the balls, not to lift the tray.

In the next mode of the apparatus, called the ball pickup mode, the tee has attained its horizontal position, and a ball has rolled into tee loading station 80. Poppet valve 50 is open, vacuum is building up in the circuit, and port 38 of four way valve 28 is open. Actuator 46 is extended and actuator 48 is retracted. Actuator 44 is extended or retracted, depending upon the mechanism for rotating the tee as aforesaid.

When the vacuum has built up to the point where the ball is firmly held in the tee, the apparatus is said to be in its ball lifting mode because the tee is being lifted into its vertical position. Accordingly, popper valve 52 is closed, the vacuum is closed, and four way valve 28 shifts to open port 38. Plunger 96 of actuator 44 is extending or retracting dependent upon the mechanism used, actuator 46 is retracted, and actuator 48 is extended. The extension of actuator 48 jogs tray 74 to assure free-flowing movement of balls.

At the conclusion of the ball lifting operation, the apparatus returns to its initial striking mode and the above-described cycle repeats when the golfer strikes the ball or otherwise removes it from the tee.

In normal operation, the above-described four modes are the only modes of the machine, in this first embodiment. However, if a ball is somehow unable to roll into tee loading station 80 even when tray-jostling actuator 48 extends and directs the balls toward said station, it is possible that the tee may return to its horizontal position, thereby activating poppet valve 50 and hence actuator 46. Plunger 94 of said actuator 46 then extends and bars entrance of a ball into tee loading station 80. The machine remains in that configuration until steps are undertaken to retract said plunger so that a ball may enter the tee loading station. In anticipation of this condition, four way valve 28 is mounted within apparatus 60 such that its diaphragm stem 28*a* protrudes slightly above the surface of top wall 68 as depicted in FIG. 1. The golfer, upon noticing that a ball is not presented for striking in the normal sequence of events, simply presses downwardly on said protruding stem 28*a*. This causes port 38 of four way valve 28 to open, thereby causing actuator 46 to retract so that a ball can enter the tee loading station and the machine can return to its normal cycle of operation. In a worst case scenario where the balls are jammed and unable to roll into the ball loading station, the golfer could remove top wall 68 of apparatus 60 and manually place a ball into the tee loading station to release the jamming.

It is also possible that a ball may be so badly scarred that a deep groove formed therein prevents its adherence to the tee because the groove prevents the vacuum from building. A ball of such physical deterioration can be removed from the system in the same way, i.e., top wall 68 is removed, the protruding diaphragm stem is depressed to retract plunger 94 of actuator 46, and the ball is removed from the system. A new ball rolls into the tee loading station and the system returns to normal operation. Alternatively, pressing down on stem 28*a* a number of times will also usually cause such a ball to be lifted by the tee because the repeated attempts to lift the ball will cause the ball to rotate until a grippable surface is presented to the tee.

The above-described configurations of the novel apparatus are summarized in the following state variable diagram.

TABLE 1

| Tee Position | Vacuum | Poppet Valve | 4-Way Valve | Cyl 1 | Cyl 2 | Cyl 3 |
|---|---|---|---|---|---|---|
| Up | Closed | Closed | Port 38 Open | Note 1 | In | In |
| Going Down | Bleeding | Closed | Port 36 Open | Note 1 | In | In |
| Down | Building | Open | Port 36 Open | Note 1 | Out | In |
| Going Up | Closed | Closed | Port 38 Open | Note 1 | In | Out |

Note 1—The position of cylinder 1 depends upon the mechanism used to lift and lower the tee, as set forth below.

There are numerous mechanisms that may be employed to reciprocate the tee between its substantially horizontal (down) position and its substantially vertical (up) position. Six of such mechanisms will be briefly described.

Figure 5:
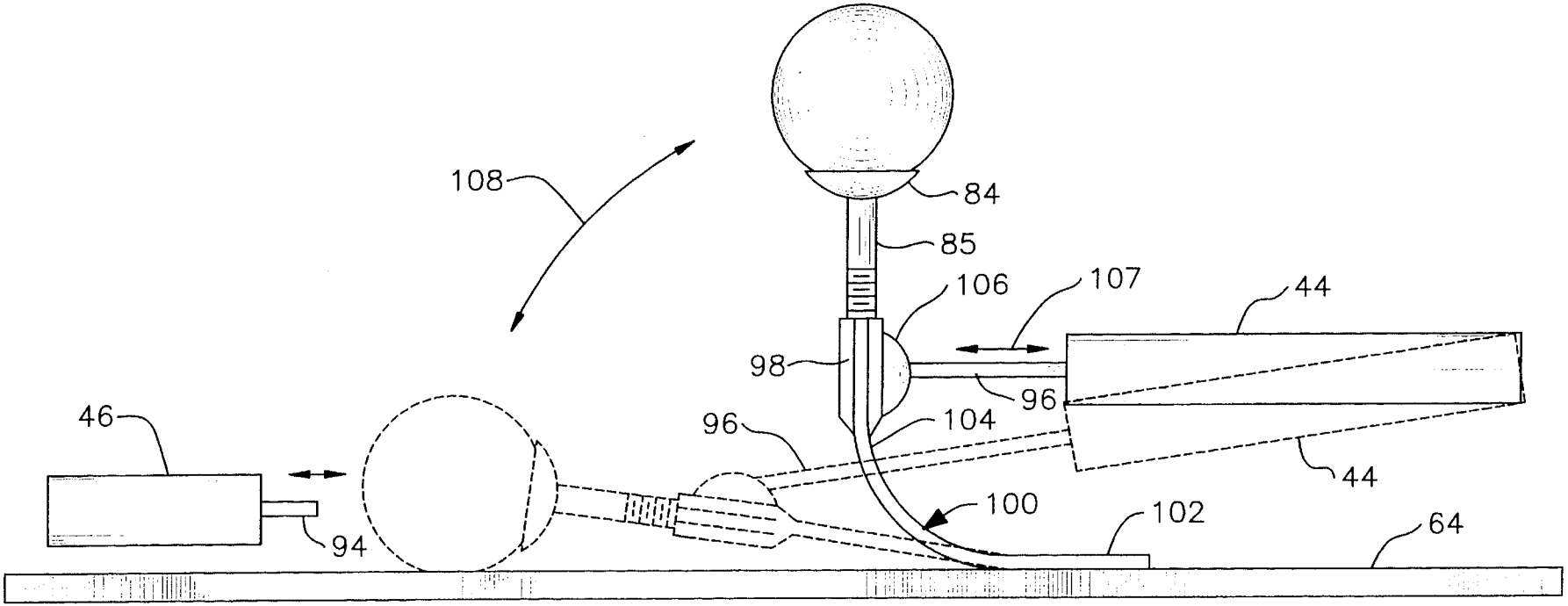
FIG. 5 is a side elevational view of a second embodiment of said means for alternately positioning the tee in horizontal and vertical positions.

FIG. 5 depicts a very simple yet elegant structure, known as the flip-up belt model, that performs the needed function effectively. A flexible and resilient flat belt member 100 has a first end 102 fixedly secured to bottom wall 64 of device 10, and a second end 104 is free. The second end is thickened as at 98 or otherwise adapted to receive therein post 85 of tee 84; post 85 may be screw threaded as depicted to enable a fine height adjustment of the tee. First cylinder or actuator 44 has a grasping element 106 pivotally mounted to the distal free end of plunger 96, and said grasping element 106 engages said thickened part 98. Accordingly, reciprocation of plunger 96 as indicated by double-headed directional arrow 107 effects reciprocation of tee 84 as indicated by double-headed directional arrow 108 and as indicated by the solid and phantom lines in said FIG. Specifically, plunger 96 of cylinder 44 is retracted or In when the tee is in its Up position and said plunger is extended or Out when the tee is in its Down position. Note that actuator 44 is pivotally mounted at its trailing end for pivotal movement in a vertical plane.

Figure 5A:
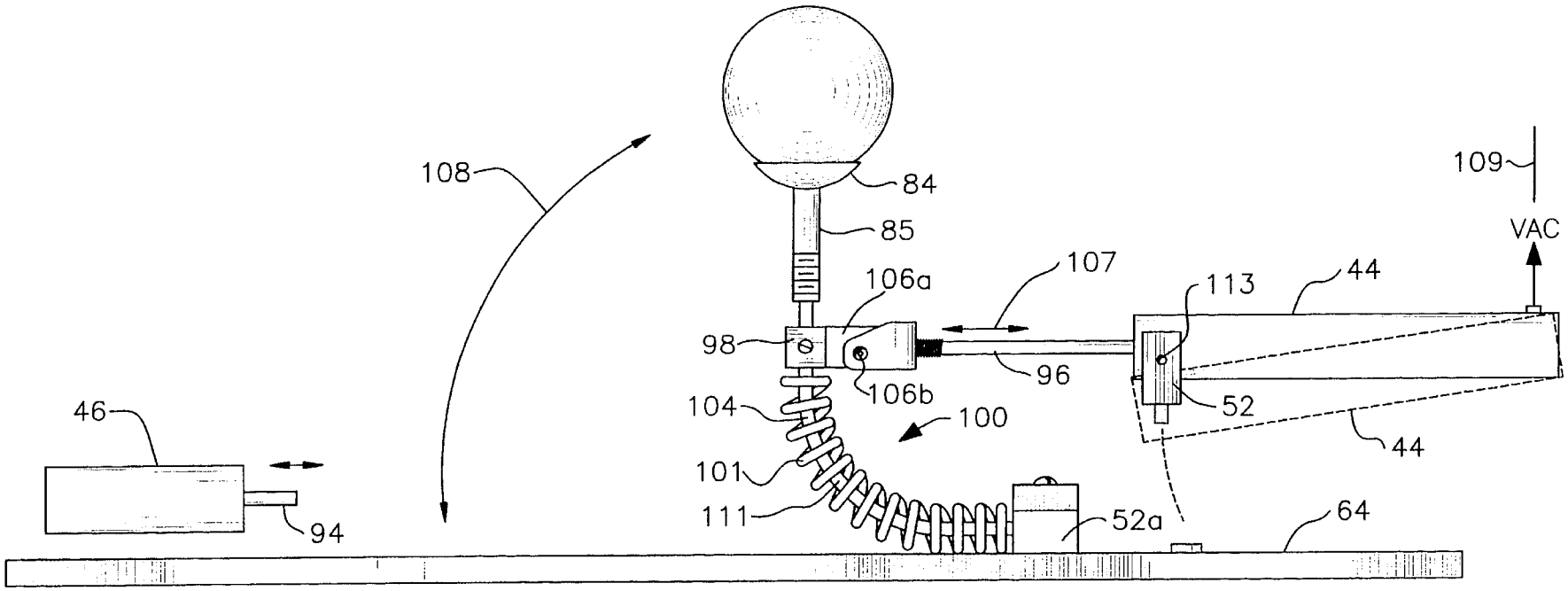
FIG. 5A is a side elevational view of a simplified version of said second embodiment.
Figure 5B:
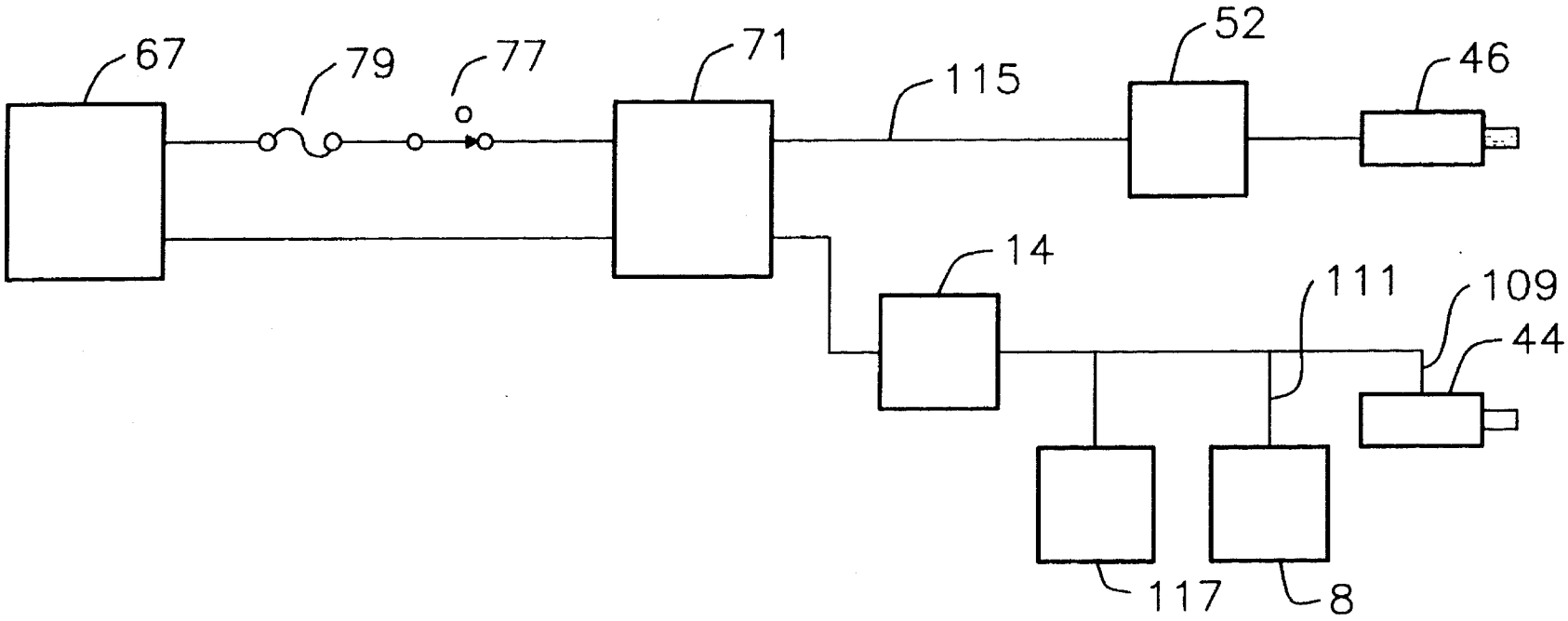
FIG. 5B is a schematic view of the control circuitry for the embodiment of FIG. 5A.

An even simpler variation of the FIG. 5 embodiment is depicted in FIG. 5A. The suction cap-like grasping element 106 of the FIG. 5 embodiment is replaced by a grasping element 106*a* which is formed by two parts interconnected by a pivot pin 106*b*. Tee 84 is screwed into coil spring 101 and line 111 is attached directly to the tee bore. Spring 101 provides the power to extend rod 96 of actuator 44, thereby eliminating the need for four way valve 28. As shown in FIG. 5B, this embodiment may be operated by a 12 volt battery 67 which runs a 32 volt vacuum pump 71. An on/off switch 77 and an inline fuse 79 are electrically connected between the battery and pump as depicted. Plunger 96 of actuator 44 is retracted by a vacuum transmitted to the trailing end of actuator 44 by vacuum line 109, and vacuum line 111 delivers vacuum to tee 84. Open port 113 (FIG. 5A) admits air into actuator 44 when the vacuum inline 109 is bleeding so that coil spring 101 may extend plunger 96 as aforesaid. Note that poppet valve 52 is mounted on the leading end of actuator 44, and that it contacts block member 52*a* when the tee is in its substantially horizontal position, i.e., when actuator 44 is pivoted downwardly by the unloading force of coil spring 101. Item 117 is a momentary valve that is pressed to reset tee 84 if it requires resetting. Note further that actuator 46 is a single action cylinder having a spring return and that pressure from the exhaust side of pump 71 is delivered over line 115.

Figure 4:
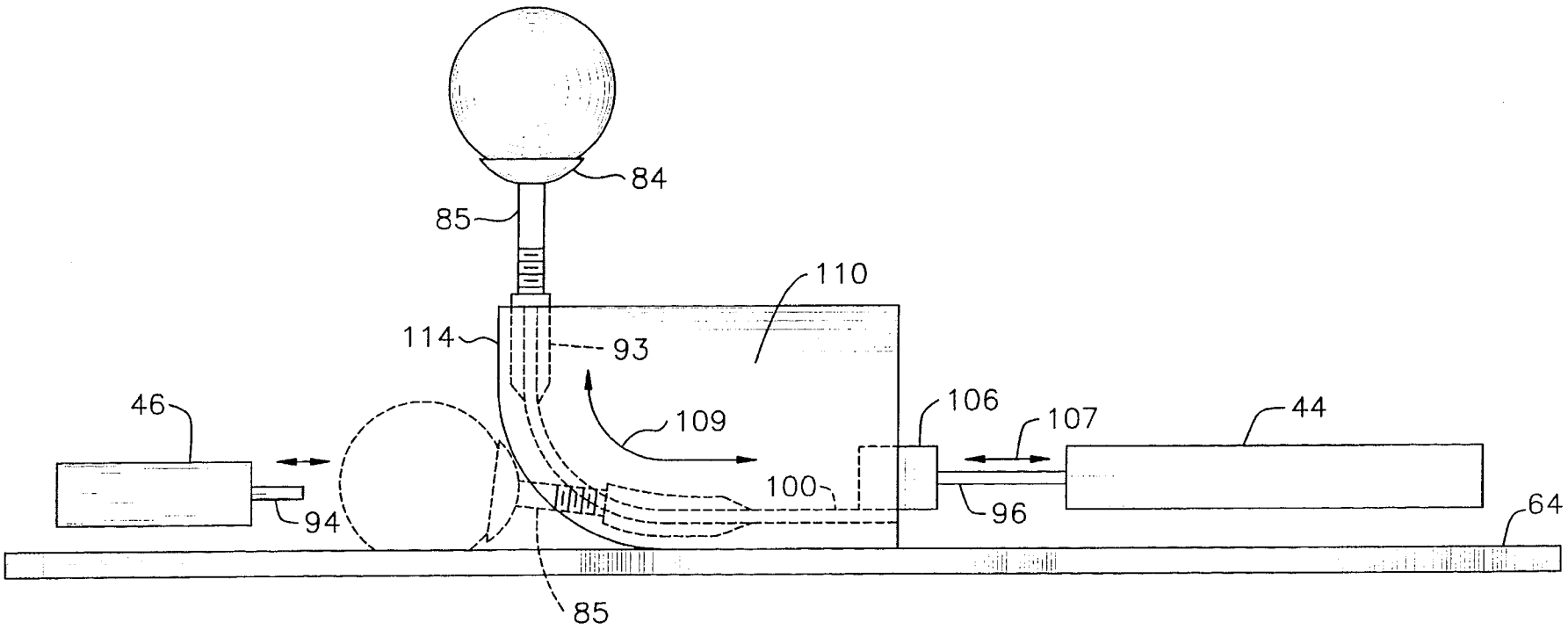
FIG. 4 is a side elevation view of a first embodiment for alternately positioning the tee in horizontal and vertical positions.

FIG. 4 depicts a mechanism quite similar to the FIG. 5 embodiment, and like parts bear the same reference numerals. A housing 110, which if formed by two transversely spaced apart walls, is mounted to device bottom wall 64 and a slot is formed in leading wall 114 of said housing and post 85 of tee 84 extends through said slot when the tee is in its substantially horizontal position as indicated in phantom lines. However, thickened part 93 of belt 100 is slideably disposed in a track formed in the opposing sidewalls of the housing so belt 100 bends and follows a path of travel as indicated by double-headed directional arrow 109 as plunger 96 reciprocates. Plunger 96 of cylinder 44 is retracted or In when the tee is in its Down position and said plunger is extended or Out when the tee is in its Up position. Note that grasping element 106 is not pivotally mounted to the trailing end of belt 100 because no pivoting occurs at the point of interconnection.

The embodiment shown in FIG. 3 is a variation of the FIG. 4 embodiment, it adds actuators 61 and 63, said actuators being mounted to a sidewall 110. In FIG. 3, the respective plungers of actuators 61, 63 are retracted and switch actuator 65, which projects upwardly through a slot formed in top wall 72 of apparatus 60 as depicted in FIG. 1 and which is under the control of the golfer, is in its corresponding position. Accordingly, neither plunger impedes the tee reciprocating means and the tee will attain its fully extended position where it holds a ball at a height simulating a tee shot, i.e., the middle position allows full extension of the tee. Moving switch 65 to a position other than its middle position on the illustrated 3-position switch supplies air under pressure to actuator 63 so that its plunger extends into the path of the tee-reciprocating means, thereby preventing its full extension. Manually throwing the switch to its third position extends the plunger of actuator 61, thereby limiting extension of the tee even more. This enables the golfer to practice tee shots, fairway shots, and rough shots, respectively.

Figure 6:
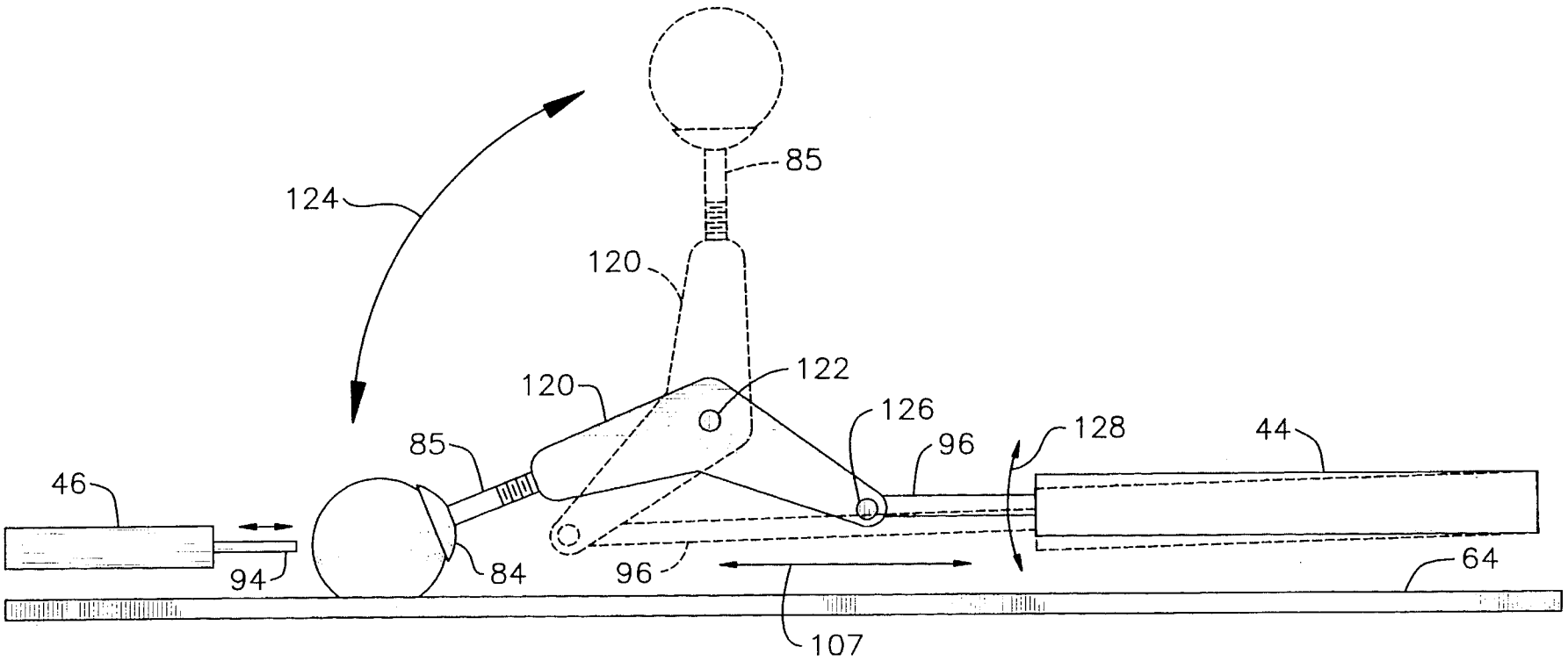
FIG. 6 is a side elevational view of a third embodiment of said means.

A bell crank 120 is employed in the embodiment of FIG. 6. The crank is pivotally mounted to a transverse shaft 122 and pivots about said shaft as indicated by double-headed directional arrow 124. The trailing end of the crank is pivotally mounted as at 126 to plunger 96. As in the first embodiment, actuator 44 is also pivotally mounted so that it can move as indicated by double-headed directional arrow 128 and by the solid and phantom lines. Plunger 96 of cylinder 44 is retracted or In when the tee is in its Down position and said plunger is extended or Out when the tee is in its Up position.

Figure 7:
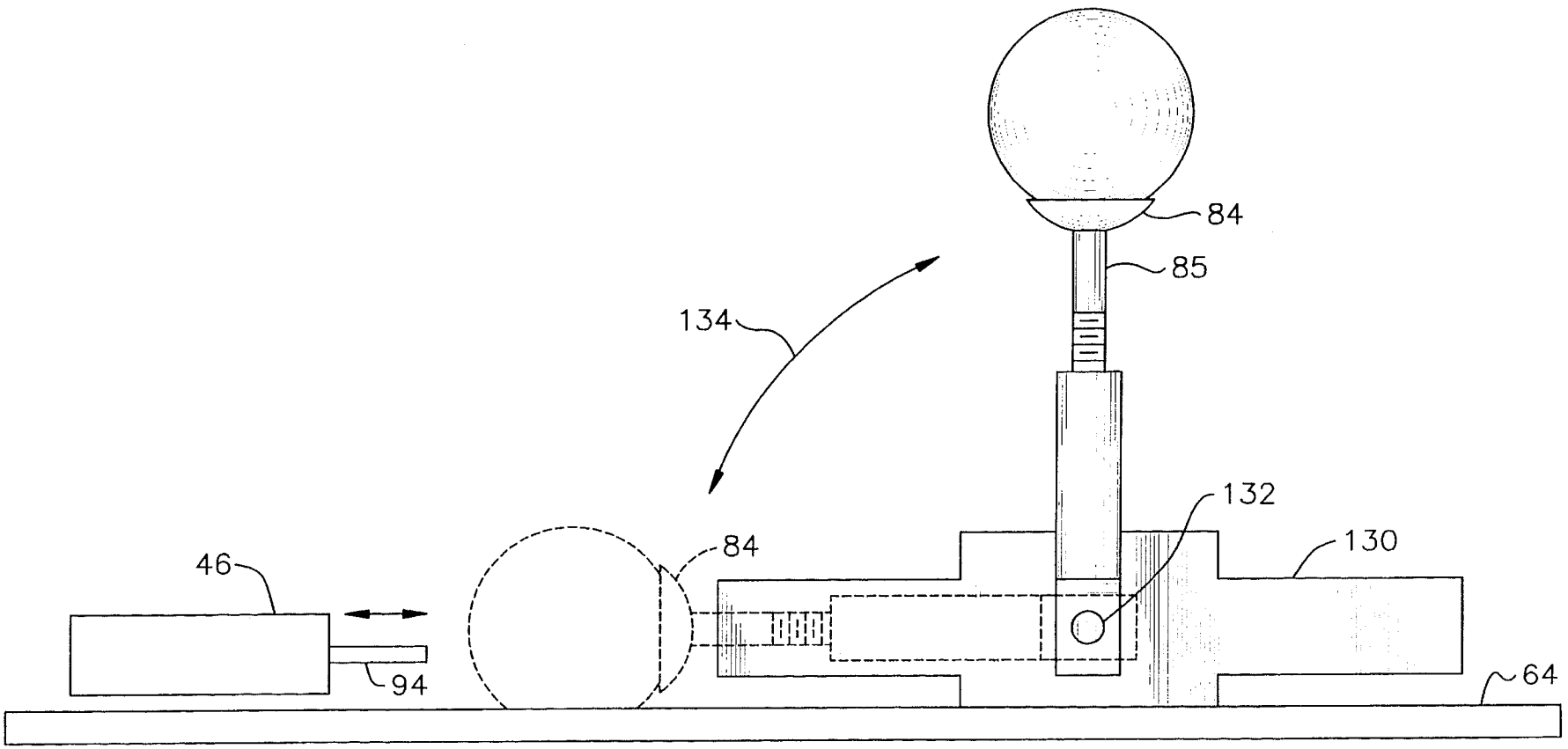
FIG. 7 is a side elevational view of a fourth embodiment of said means.

A rotary actuator 130 is depicted in FIG. 7. Post 85 of tee 84 is conjointly rotatable with output shaft 132 of the rotary actuator. Thus, the tee reciprocates between its vertical and horizontal positions as indicated by double-headed directional arrow 134 as the rotary actuator operates. First cylinder 44 is therefore not used in this embodiment.

Figure 8:
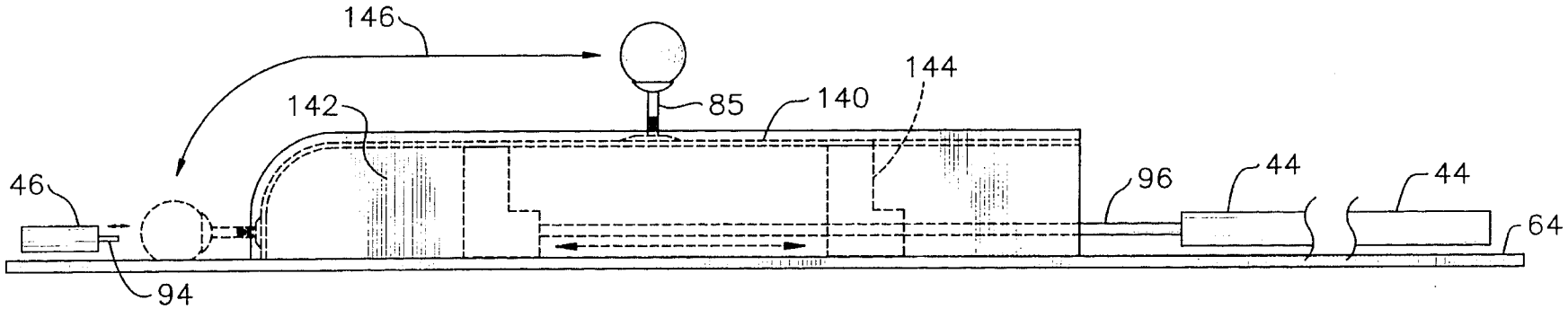
FIG. 8 is a side elevational view of a fifth embodiment of said means.

FIG. 8 depicts a mechanism that not only reciprocates the tee between a horizontal and vertical position, but also carries the tee along a horizontal track after it has attained its vertical position. Thus, the ball moves parallel to the golfer, approaching from the direction of the hole, so that the golfer may increase hand and eye coordination by hitting a moving target. An elongate flexible and resilient belt 140 has its opposite longitudinally extending sides slideably received within opposing tracks formed in a housing 142. Engaging device 144 securely engages the belt at a preselected location as depicted so that reciprocation of plunger 96 effects the path of travel indicated by double-headed directional arrow 146. Plunger 96 of cylinder 44 is retracted or In when the tee is in its Up position and moving toward the golfer away from the target, and said plunger is extended or Out when the tee is in its Down position.

Figure 9:
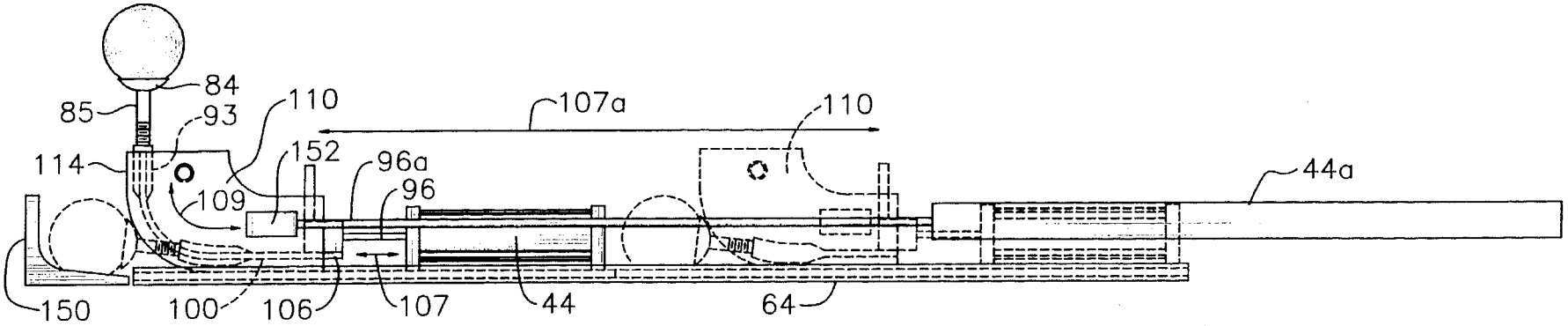
FIG. 9 is a side elevational view of a sixth embodiment of said means.
Figure 10:
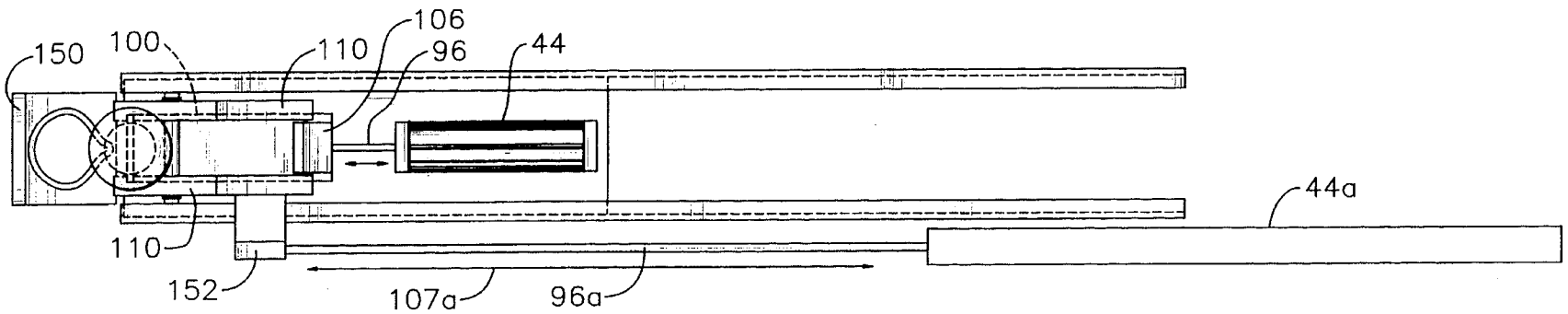
FIG. 10 is a top plan view of the sixth embodiment of said means.

A final embodiment, depicted in FIGS. 9 and 10, is somewhat a combination of the structure of the FIG. 4 embodiment and a variation of the FIG. 8 embodiment. More specifically, belt 100 has its opposite edges slideably disposed with grooves formed in the transversely spaced apart sidewalls of housing 110, and reciprocation of plunger 96 of actuator 44 effects the rotation of tee 84 as in the FIG. 6 embodiment. Housing 110 is reciprocated over a relatively long distance by plunger 96*a* of actuator 44*a* as indicated by double-headed directional arrow 107*a*. Element 152 interconnects plunger 96*a* and housing 110. Note passive stop member 150 which obviates the need for actuator 46.

In all embodiments, pressure regulator 16 (FIG. 3) is used primarily to regulate the vacuum generator and to provide coarse adjustment to control the speed of operation of the means employed to lift and lower the tee. Thus, throttling the flow of air causes the tee to pivot slower. Flow control valve 45*a* provides a fine control for the pivotal travel of the tee and the horizontal travel speed of the ball in the embodiment of FIGS. 8 and 9.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for positioning a golf ball onto a tee, comprising:

a source of negative pressure;

a tee having a ball-supporting surface and a base;

a bore extending from said ball-supporting surface through said base to place said ball-supporting surface in fluid communication with said source of negative pressure so that a golf ball seated on said ball-supporting surface is held thereto by negative pressure;

said tee having a first, substantially horizontal position and a second, substantially vertical position;

tee reciprocating means for reciprocating said tee between said substantially horizontal position and said substantially vertical position;

a tee-loading station where a golf ball is positioned onto said tee when said tee is in said substantially horizontal position;

said tee-loading station having a size sufficient to admit thereinto only one golf ball at a time;

a sloped ramp for holding a plurality of golf balls, said sloped ramp being sloped toward said tee-loading station to deliver golf balls to said tee-loading station;

tee-loading means for driving a ball in said tee loading station into engagement with said ball-supporting surface only when said tee is in its substantially horizontal position;

control means for activating said tee-reciprocating means to move said tee from said substantially horizontal position to said substantially vertical position after said ball has been driven into engagement with said ball-supporting surface by said tee-loading means and for rotating said tee from said substantially vertical position to said substantially horizontal position when said ball is disengaged from said ball-supporting surface;

said control means activating said tee-loading means only when said tee is in its substantially horizontal position.

2. The apparatus of claim 1, wherein said tee-reciprocating means is a first actuator having a reciprocating plunger slideably mounted therein, said reciprocating plunger of said first actuator having a retracted position and an extended position.

3. The apparatus of claim 2, wherein said tee-loading means is a second actuator having a reciprocating plunger slideably mounted therein, said reciprocating plunger of said second actuator having a retracted position and an extended position and said reciprocating plunger of said second actuator driving a ball in said tee-loading station into engagement with said ball-supporting surface when said reciprocating plunger of said second actuator is in its extended position.

4. The apparatus of claim 3, further comprising a third actuator having a reciprocating plunger slideably mounted therein, said reciprocating plunger of said third actuator having a retracted position and an extended position and being connected to said sloped ramp, said sloped ramp having an increased slope when said reciprocating plunger of said third actuator is extended and said sloped ramp having a decreased slope when said reciprocating plunger of said third actuator is retracted.

5. The apparatus of claim 4, wherein said control means causes the reciprocating plunger of said third actuator to extend when a ball is disengaged from said tee, said extension causing a ball on said sloped ramp to roll into said ball-loading station, and to retract when a ball is loaded onto said tee by extension of said reciprocating plunger of said second actuator.

6. The apparatus of claim 5, wherein said control means includes a four way valve in fluid communication with said first, second, and third actuators.

7. The apparatus of claim 1, wherein said tee reciprocating means comprises:

a housing having a bottom wall and a top wall spaced apart from one another by a plurality of upstanding side walls;

a flexible and resilient flat belt having a first end fixedly secured to said bottom wall and a free second end;

said second end being adapted to receive therein a post of said tee;

an actuator having a reciprocable plunger;

a grasping element pivotally mounted to a distal free end of said plunger, said grasping element engaging said second end of said flat belt member;

said actuator being pivotally mounted for pivotal movement in a vertical plane;

whereby reciprocation of the plunger effects reciprocation of said tee.

8. The apparatus of claim 7, further comprising a coil spring disposed about a vacuum line so that a bias supplied by said coil spring returns the tee to its substantially horizontal position when the apparatus is in repose;

a housing having a pair of transversely spaced apart sidewalls, each of said sidewalls having a curved leading end;

a flexible and resilient belt having a leading end adapted to engage a post of a golf tee;

an actuator having a plunger attached to a trailing end of said belt;

a track formed in each of said transversely spaced apart sidewalls and said belt having opposite edges slidingly disposed in said track so that said belt bends and follows a path of travel defined by said track as said plunger reciprocates;

said path of travel including a substantially ninety degree bend so that said tee is disposed in said substantially horizontal position when said plunger is retracted and in said substantially vertical position when said plunger is extended.

9. The apparatus of claim 1, wherein said tee reciprocating means comprises:

a housing having a bottom wall and a top wall spaced apart from one another by a plurality of upstanding side walls;

an actuator having a plunger mounted within said housing;

a support wall mounted in upstanding relation to said bottom wall;

a transversely disposed shaft mounted on said support wall;

a bell crank having a trailing end pivotally attached to said plunger;

said bell crank being pivotally mounted to said transversely disposed shaft for pivotal movement about said shaft as said plunger reciprocates.

10. The apparatus of claim 1, wherein said tee reciprocating means comprises:

a rotary actuator having an output shaft that rotatably reciprocates over a substantially ninety degree range under control of said control means;

said base of said tee being mounted to and hence conjointly rotatable with said output shaft so that said tee reciprocates between its vertical and horizontal positions as said rotary actuator operates.

11. The apparatus of claim 1, wherein said tee reciprocating means comprises:

tee-transporting means for carrying said tee along a horizontal path after said tee has attained said substantially vertical position;

said tee-transporting means including a flexible and resilient belt having a leading end adapted to engage said base of said golf tee;

a housing having a bottom wall and a top wall spaced apart from one another by a plurality of upstanding side walls;

an actuator positioned within said housing, said actuator having a plunger attached to a trailing end of said belt;

a pair of transversely spaced apart, belt-supporting walls mounted in upstanding relation to said bottom wall of said housing;

an elongate track formed in each of said belt-supporting walls and said belt having opposite edges slidingly disposed in said elongate track so that said belt bends and follows a path of travel defined by said track as said plunger reciprocates;

whereby said ball, after attaining said substantially vertical position, moves parallel to a golfer, approaching from the direction of a golf hole, so that the golfer may increase hand and eye coordination by hitting a moving target.

12. The apparatus of claim 1, wherein said source of negative pressure is a battery operated vacuum pump, wherein said apparatus is portable, and wherein said apparatus operates quietly.

13. The apparatus of claim 1, wherein said source of negative pressure is a venturi effect vacuum generator that receives energy from an external compressor.

14. The apparatus of claim 1, further comprising:

tee height limiting means for limiting the height to which a ball supported by said tee is lifted when the tee is in its vertical position.

15. The apparatus of claim 14, wherein said tee height limiting means includes a fourth actuator having a plunger, said fourth actuator being mounted adjacent said tee so that extension of said plunger of said fourth actuator blocks movement of said tee so that said tee is deployed at a height below a fully deployed height.

16. The apparatus of claim 15, wherein said tee height limiting means includes a fifth actuator having a plunger, said fifth actuator being mounted adjacent said tee so that extension of said plunger of said fifth actuator blocks movement of said tee so that said tee is deployed at a height below said fully developed height.

17. The apparatus of claim 1, wherein said tee is of elastomeric construction and has a threaded stem that engages a threaded base so that the height of said tee is adjustable with respect to said base by rotating said tee about its rotational axis of symmetry.

18. The apparatus of claim 17, wherein said ramp has a size sufficient to eliminate any need for a ball storage means external to said apparatus.

19. The apparatus of claim 1, wherein said ball-supporting surface of said tee is sufficiently flexible and resilient to allow a vacuum seal against a golf ball's dimpled surface, and wherein said ball-supporting surface is formed of a material sufficiently durable to withstand repeated use.

* * * * *